US011114733B2

(12) United States Patent
Doyle et al.

(10) Patent No.: US 11,114,733 B2
(45) Date of Patent: Sep. 7, 2021

(54) WAVEGUIDE INTERCONNECT TRANSITIONS AND RELATED SENSOR ASSEMBLIES

(71) Applicant: VEONEER US, INC., Southfield, MI (US)

(72) Inventors: Scott B. Doyle, Sudbury, ME (US); Angelos Alexanian, Lexington, ME (US); Konstantinos Konstantinidis, Wurzburg (DE)

(73) Assignee: Veoneer US, Inc., Southfield, MI (US)

( * ) Notice: Subject to any disclaimer, the term of this patent is extended or adjusted under 35 U.S.C. 154(b) by 37 days.

(21) Appl. No.: 16/520,260

(22) Filed: Jul. 23, 2019

(65) Prior Publication Data

US 2021/0028527 A1 Jan. 28, 2021

(51) Int. Cl.

| | |
|---|---|
| ***H01P 3/12*** | (2006.01) |
| ***H01Q 1/32*** | (2006.01) |
| ***H01Q 13/18*** | (2006.01) |

(52) U.S. Cl.

CPC ..... *H01P 3/12* (2013.01); *H01Q 1/32* (2013.01); *H01Q 13/18* (2013.01)

(58) Field of Classification Search

None

See application file for complete search history.

(56) References Cited

U.S. PATENT DOCUMENTS

| | | | |
|---|---|---|---|
| 7,132,905 | B2 | 11/2006 | Sano |
| 8,779,995 | B2 | 7/2014 | Kirino et al. |
| 8,803,638 | B2 | 8/2014 | Kildal |
| 9,153,851 | B2 | 10/2015 | Nakamura |
| 9,252,475 | B2 | 2/2016 | Milyakh et al. |
| 9,666,931 | B2 | 5/2017 | Suzuki |
| 10,164,344 | B2 | 12/2018 | Kirino et al. |
| 10,852,390 | B2 * | 12/2020 | Izadian ..... G01S 7/41 |
| 2010/0188281 | A1 * | 7/2010 | Hayata ..... H01P 1/2007 342/118 |
| 2011/0050356 | A1 | 3/2011 | Nakamura et al. |

(Continued)

FOREIGN PATENT DOCUMENTS

| | | |
|---|---|---|
| CN | 102931492 | 2/2015 |
| CN | 106207357 | 12/2016 |

OTHER PUBLICATIONS

CN102931492, Feb. 11, 2015, Beijing Institute of Telemetry Technology, Machine Translation (9 pages).

(Continued)

*Primary Examiner* — Crystal L Hammond

(74) *Attorney, Agent, or Firm* — Matthew D. Thayne; Thayne and Davis LLC

(57) ABSTRACT

Antenna assemblies for vehicles, such as RADAR sensor antenna assemblies. In some embodiments, the assembly may comprise an antenna block defining a first waveguide on a first side of the antenna block and a second waveguide on a second side of the antenna block. The assembly may comprise a vertical waveguide extending from the first side of the antenna block to the second side of the antenna block. The vertical waveguide may be functionally coupled with the first waveguide and the second waveguide. One or both of the first and second waveguides may comprise a transitional region configured to facilitate redirection of electromagnetic waves to the vertical waveguide.

21 Claims, 8 Drawing Sheets

(56) References Cited

U.S. PATENT DOCUMENTS

| | | | | |
|---|---|---|---|---|
| 2017/0187121 | A1 | 6/2017 | Kirino et al. | |
| 2017/0187124 | A1* | 6/2017 | Kirino | H01Q 1/3266 |
| 2018/0351261 | A1 | 12/2018 | Kamo et al. | |

OTHER PUBLICATIONS

CN106207357, Dec. 7, 2017, Chengdu Xanaway Technology Co., Ltd., Machine Translation (58 pages).

* cited by examiner

WAVEGUIDE INTERCONNECT TRANSITIONS AND RELATED SENSOR ASSEMBLIES

SUMMARY

Disclosed herein are various embodiments of waveguide structures that may be used in connection with various electrical devices comprising electromagnetic waveguides, such as RADAR sensor modules for vehicles. Some of the waveguide structures disclosed herein may be configured to facilitate a transition between two adjacent waveguides, such as a "gap" or groove waveguide, which may extend horizontally along the surface of a waveguide block or other structure in some embodiments, and a "tunnel" waveguide, which may extend between opposing surfaces of the waveguide block or other structure. Preferably, these structures are configured to facilitate a smooth transition so as to eliminate or at least reduce signal loss and/or distortion of the electromagnetic waves redirected in the transitional region/structure of a sensor assembly or other structure incorporating the transitional waveguide structure. In some embodiments, various features and/or elements of the structures disclosed herein, such as lengths, widths, heights, and/or angles of waveguide ridge portions relative to adjacent waveguide ridges or other structures, and/or step heights of waveguide ridges adjacent to other waveguide ridges or adjacent structures, may be tuned or adjusted as needed to achieve desired performance in accordance with particular design considerations.

In a more particular example of an antenna module according to some embodiments, the module may comprise an antenna block defining a first waveguide on a first side of the antenna block and a second waveguide on a second side of the antenna block. A vertical waveguide may extend from the first side of the antenna block to the second side of the antenna block to deliver electromagnetic waves therethrough. The vertical waveguide may be coupled with the first and second waveguides. One or both of the first and second waveguides may comprise a transitional region adjacent to the vertical waveguide configured to facilitate redirection of electromagnetic waves to and/or from the vertical waveguide.

In some embodiments, the vertical waveguide may comprise a first ridge positioned on a first side of the vertical waveguide and extending between the first side of the antenna block and the second side of the antenna block and a second ridge positioned on a second side of the vertical waveguide opposite from the first side of the vertical waveguide and extending between the first side of the antenna block and the second side of the antenna block.

The vertical waveguide may comprise an opening or hole between the first side of the antenna block and the second side of the antenna block. In some such embodiments, the opening/hole may be in the shape of a letter H, or at least substantially in the shape of a letter H, in cross section. This shape may, in some embodiments, be due to the presence of a pair of opposing ridges formed within the hole/opening.

In some embodiments, the transitional region may comprise one or more adjustable/tuning elements configured to allow for adjustment/tuning of one or more physical characteristics of the transitional region to reduce at least one of signal loss and signal distortion of a signal carried by the electromagnetic waves redirected in the transitional region. For example, the at least one tuning element may comprise one or more of a step between a tuning section of a first waveguide ridge of the first waveguide and the first ridge of the vertical waveguide, the depth of which may be adjusted as a tuning element. As another example, one or more of a height, a length, and a width of the tuning section of the first waveguide ridge of the first waveguide adjacent to the first ridge of the vertical waveguide may be adjusted.

As still another example, in some embodiments, an offset region may be provided and may extend along the first waveguide. The offset region may direct the first waveguide at an acute angle relative to one or both of the first and second ridges of the vertical waveguide. In some such embodiments, the offset region may comprise an offset ridge portion, which may comprise multiple straight ridge portions angled relative to each other or a curved ridge portion extending the offset ridge portion away from the vertical waveguide. The angle to which the offset region extends vis-à-vis the axis of the adjacent ridge portion and/or waveguide structure may be varied as desired as another tuning factor.

As yet another example, in some embodiments, a terminal tuning ridge may be positioned opposite an opening in an adjacent waveguide structure, such as a tunnel or hole waveguide structure. The terminal tuning ridge may be positioned on a side of the first waveguide opposite from a side from which electromagnetic waves directed through the vertical waveguide are transmitted relative to the vertical waveguide. Various aspects of the terminal tuning ridge, such as its length, width, and/or height, may be adjusted to provide an additional tuning factor.

In some embodiments, the first waveguide and the second waveguide may each comprise a waveguide groove and a waveguide ridge positioned therein. One or more sections and/or portions of the waveguide ridges of the first and second waveguides may be functionally coupled with, in some such embodiments contiguous with, at least one of the first ridge and the second ridge of the vertical waveguide.

In some embodiments, the waveguide grooves of one or both of the first waveguide and the second waveguide may be at least partially defined by a plurality of posts positioned opposite from one another and having a waveguide ridge positioned within the respective waveguide groove between opposite posts of the plurality of posts. In other embodiments, the waveguides may be defined by trench-like grooves rather than adjacent posts.

In another example of an antenna module according to some embodiments, the module may comprise a first waveguide defined by a first plurality of posts formed in a waveguide layer of the antenna module, such as an antenna block and/or casting in some embodiments, and a first waveguide ridge positioned in between at least two opposing rows of the first plurality of posts. The module may further comprise a second waveguide defined by a second plurality of posts formed in the waveguide layer and a second waveguide ridge positioned in between at least two opposing rows of the second plurality of posts. A vertical waveguide may be functionally and/or physically coupled with the first waveguide and the second waveguide and may extend through the waveguide layer. The vertical waveguide may be configured to direct electromagnetic waves between the first waveguide and the second waveguide and may comprise one or more ridges extending through the waveguide layer. In some embodiments, the vertical waveguide may comprise two opposing ridges extending along opposing sides of a hole defining the vertical waveguide.

Some embodiments may further comprise a transitional region operably coupled between a first waveguide on a surface of the waveguide layer and the vertical waveguide. The transitional region may be configured to facilitate redirection of electromagnetic waves from the first waveguide to the vertical waveguide and may comprise a transitional ridge. The transitional region may further comprise one or more tuning features, such as one or more steps in a height of the transitional ridge, one or more offset regions in which the transitional ridge extends away from an axis of the vertical waveguide, in some cases such that one or both of the first ridge and a second ridge of the vertical waveguide is not aligned with a portion of the first waveguide ridge adjacent to the transitional region and/or such that the transitional ridge extends at an angle with respect to the vertical waveguide and/or one or both of the first and second ridges of the vertical waveguide.

In some embodiments, the transitional ridge may be contiguous with and operably coupled with the first ridge of the vertical waveguide at a first end and contiguous with and operably coupled with the first waveguide ridge at a second end opposite from the first end.

In some embodiments, the one or more steps may be positioned at a terminal end of the transitional ridge adjacent to the vertical waveguide.

In some embodiments, the transitional region may further comprise a terminal tuning ridge positioned on a side of the first waveguide opposite from the vertical waveguide. In some such embodiments, the terminal tuning ridge may extend from the waveguide layer at a height that differs from a height of the transitional ridge.

In some embodiments, the one or more offset regions may comprise a straight offset portion extending from the vertical waveguide at an acute angle and/or one or more curved portions extending away from the vertical waveguide. One or more other straight portions may extend from the initial straight portion, either instead of or in addition to providing one or more curved portion.

In some embodiments, the transitional region further may further comprise a tuning section, which may be positioned in between the offset region and the vertical waveguide. The tuning section may be at least one of angled and stepped relative to the straight offset region, such as providing a tuning ridge that is stepped and/or angled relative to one or more adjacent ridge portions. In some embodiments, the tuning section may be both angled and stepped relative to the straight offset portion In some embodiments, the transitional ridge may comprise a first step coincident with at least a portion of the first ridge of the vertical waveguide and a second step between the straight offset portion and the tuning section. The steps may be abrupt in some embodiments and/or may comprise ramped or curved portions.

In still another example of an antenna module according to still other embodiments, the module may comprise an antenna block comprising a first waveguide on a first side of the antenna block and a second waveguide on a second side of the antenna block. A vertical waveguide may extend through the antenna block and may be operably coupled with the first waveguide and the second waveguide to facilitate guidance of electromagnetic waves between the first waveguide and the second waveguide. In some embodiments, the vertical waveguide may also comprise at least one vertical ridge protruding from an opening formed in the antenna block.

A transitional waveguide section may be positioned on the first side of the antenna block and may be operably coupled to the first waveguide and the vertical waveguide. The transitional waveguide may be configured to facilitate redirection of electromagnetic waves from the first waveguide to the vertical waveguide and may comprise a horizontal ridge. In some embodiments, the horizontal ridge may also at least partially define one or more vertical ridges of the vertical waveguide. The transitional waveguide may further comprise a transitional ridge extending in a direction angled away from a direction from which the at least one vertical ridge extends from a surface of the opening. In some embodiments, the transitional ridge may extend along a straight line or, alternatively, a curved line away from the direction from which the at least one vertical ridge extends from a surface of the opening.

The features, structures, steps, or characteristics disclosed herein in connection with one embodiment may be combined in any suitable manner in one or more alternative embodiments.

BRIEF DESCRIPTION OF THE DRAWINGS

Non-limiting and non-exhaustive embodiments of the disclosure are described, including various embodiments of the disclosure with reference to the figures, in which.

DETAILED DESCRIPTION

A detailed description of apparatus, systems, and methods consistent with various embodiments of the present disclosure is provided below. While several embodiments are described, it should be understood that the disclosure is not limited to any of the specific embodiments disclosed, but instead encompasses numerous alternatives, modifications, and equivalents. In addition, while numerous specific details are set forth in the following description in order to provide a thorough understanding of the embodiments disclosed herein, some embodiments can be practiced without some or all of these details. Moreover, for the purpose of clarity, certain technical material that is known in the related art has not been described in detail in order to avoid unnecessarily obscuring the disclosure.

The embodiments of the disclosure may be best understood by reference to the drawings, wherein like parts may be designated by like numerals. It will be readily understood that the components of the disclosed embodiments, as generally described and illustrated in the figures herein, could be arranged and designed in a wide variety of different configurations. Thus, the following detailed description of the embodiments of the apparatus and methods of the disclosure is not intended to limit the scope of the disclosure, as claimed, but is merely representative of possible embodiments of the disclosure. In addition, the steps of a method do not necessarily need to be executed in any specific order, or even sequentially, nor need the steps be executed only once, unless otherwise specified. Additional details regarding certain preferred embodiments and implementations will now be described in greater detail with reference to the accompanying drawings.

Figure 1:
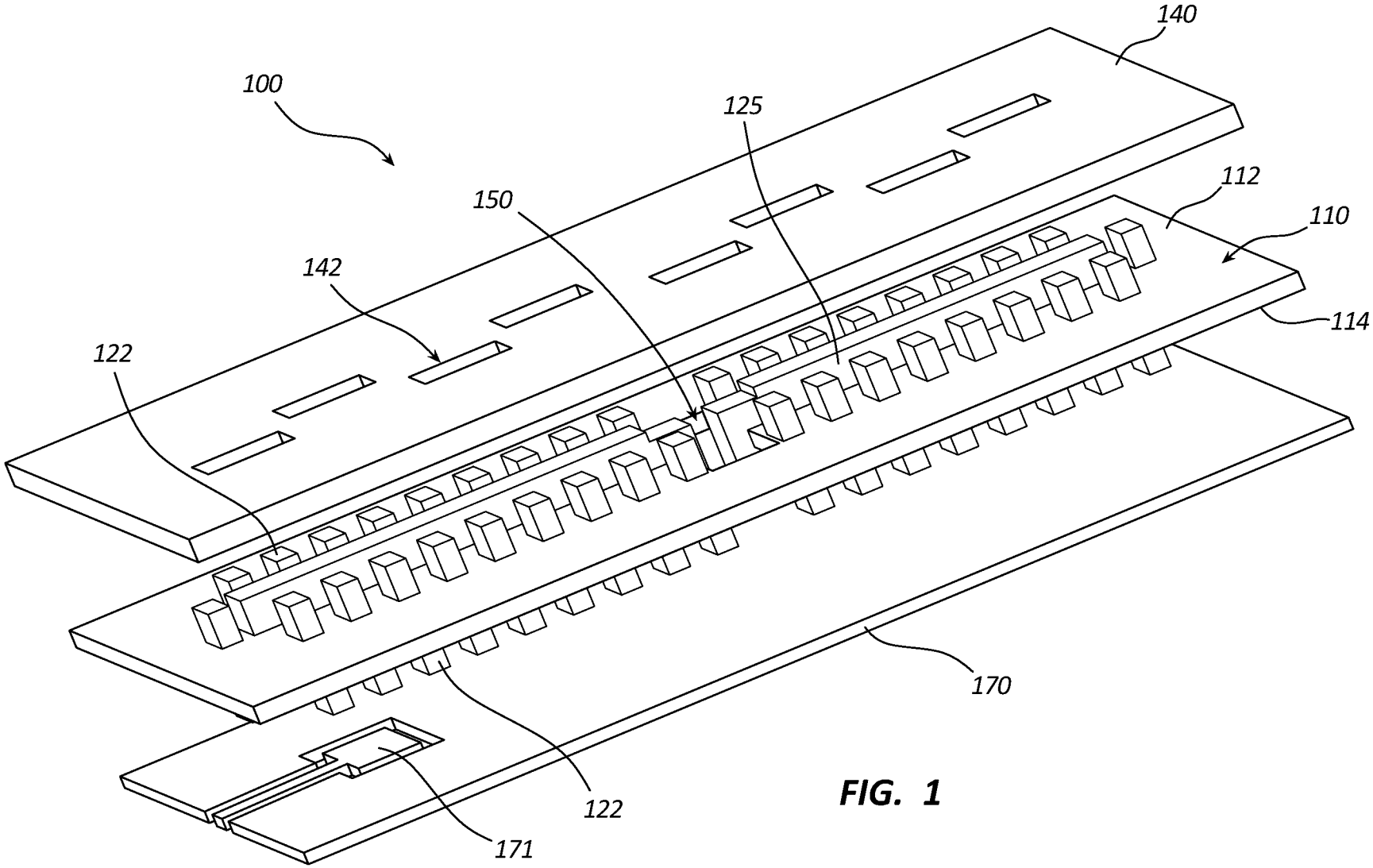
FIG. 1 is an exploded, perspective view of a waveguide/antenna assembly that may be incorporated into a vehicle RADAR sensor assembly or another sensor assembly, according to some embodiments.

FIG. 1 depicts depict an antenna assembly 100 that may be incorporated into or otherwise used with a vehicle sensor, such as a RADAR sensor assembly, other any other desired sensor or other assembly utilizing electromagnetic waveguides, according to some embodiments. Antenna assembly 100 comprises an antenna block 110 that defines, either in whole or in part, one or more waveguides as part of an antenna array comprising one or more antennae, on one or both sides of antenna block 110. Thus, as depicted in FIG. 1, antenna block 110 comprises a plurality of posts 122 arranged in opposing rows on a first side 112 of antenna block 110 to define a waveguide groove therebetween. Antenna block 110 further comprises a plurality of posts 122 arranged in opposing rows on a second side 114 of antenna block 110 opposite first side 112 to define another waveguide groove.

It should be understood that although, in preferred embodiments, any number of antennae may be provided and therefore any desired number of corresponding antennae structures—such as a plurality of waveguides, grooves, etc.—may be provided, it is contemplated that some embodiments may comprise an array having a single antenna and therefore only a single waveguide, for example. Such antenna/waveguide/groove may curve about the block/assembly rather than be in a series of parallel lines in some embodiments. As another example, in some embodiments, grooves, slots, or the like may be arranged in a disc formation, or any other suitable formation, including linear, curved, etc. In addition, although the waveguide grooves in the depicted embodiment are defined by rows of posts, it should also be understood that waveguides may be defined in alternative ways in other embodiments, such as by forming a groove within a solid structure (i.e., no posts extending up from the structure), or in any other suitable manner available to those of ordinary skill in the art.

In preferred embodiments, antenna block 110 may comprise a casting, such as a casting comprising a Zinc or other suitable preferably metal material. However, in other contemplated embodiments, block 110 may instead, or in addition, comprise a plastic or other material. In some such embodiments, metallic inserts, coatings, or the like may be used if desired. In typical sensor assemblies, which, as previously mentioned, may be configured specifically for use in connection with vehicles, other structures may be combined with block/casting 110.

For example, in the depicted embodiment, a slotted layer 140 comprising a plurality of slots 142 may be coupled to the antenna block 110, in some cases along with other layers and/or elements that are not depicted herein to avoid obscuring the disclosure, to form antenna assembly 100. In other embodiments, electromagnetic radiation may be emitted using other slots or openings not formed in a separate layer. For example, in some embodiments, slots may be formed in antenna block 110 itself.

Slotted layer 140 of antenna assembly 100 may comprise one or more rows of slots 142, which may correspond in number and/or location with the antennae partially defined by antenna block 110. As also shown in FIG. 1, one or more of the rows of slots 142 may be staggered with respect to one another. As discussed below, in some embodiments, this staggering configuration may be such that each slot 142 extends along a side of a waveguide groove defined by posts 122, in some such embodiments along a ridge 125 extending within the waveguide groove, and such that each slot 142 extends along an opposite side of the groove and/or ridge 125 relative to its adjacent slot 142 to facilitate a desired guidance of RF or other electromagnetic radiation though slots 142. However, those of ordinary skill in the art will appreciate that a wide variety of alternative configurations are possible depending upon the desired functionality and specifications of the waveguide/sensor assembly.

Preferably, slotted layer 140 comprises a metal or other conductive material. Layer 140 may be coupled with block 110 in a variety of possible ways. For example, an adhesive, solder, heat stakes, screws, other fasteners, and the like may be used to couple layer 140 to block 110. In some embodiments, as discussed below, another layer, such as a layer of adhesive tape, may be inserted in between layers 110 and 140, which may, either entirely or in part, be used to provide this coupling. In embodiments in which solder is used, such solder may be applied to the top of one or more (in some embodiments, all) of posts 122.

Figure 4:
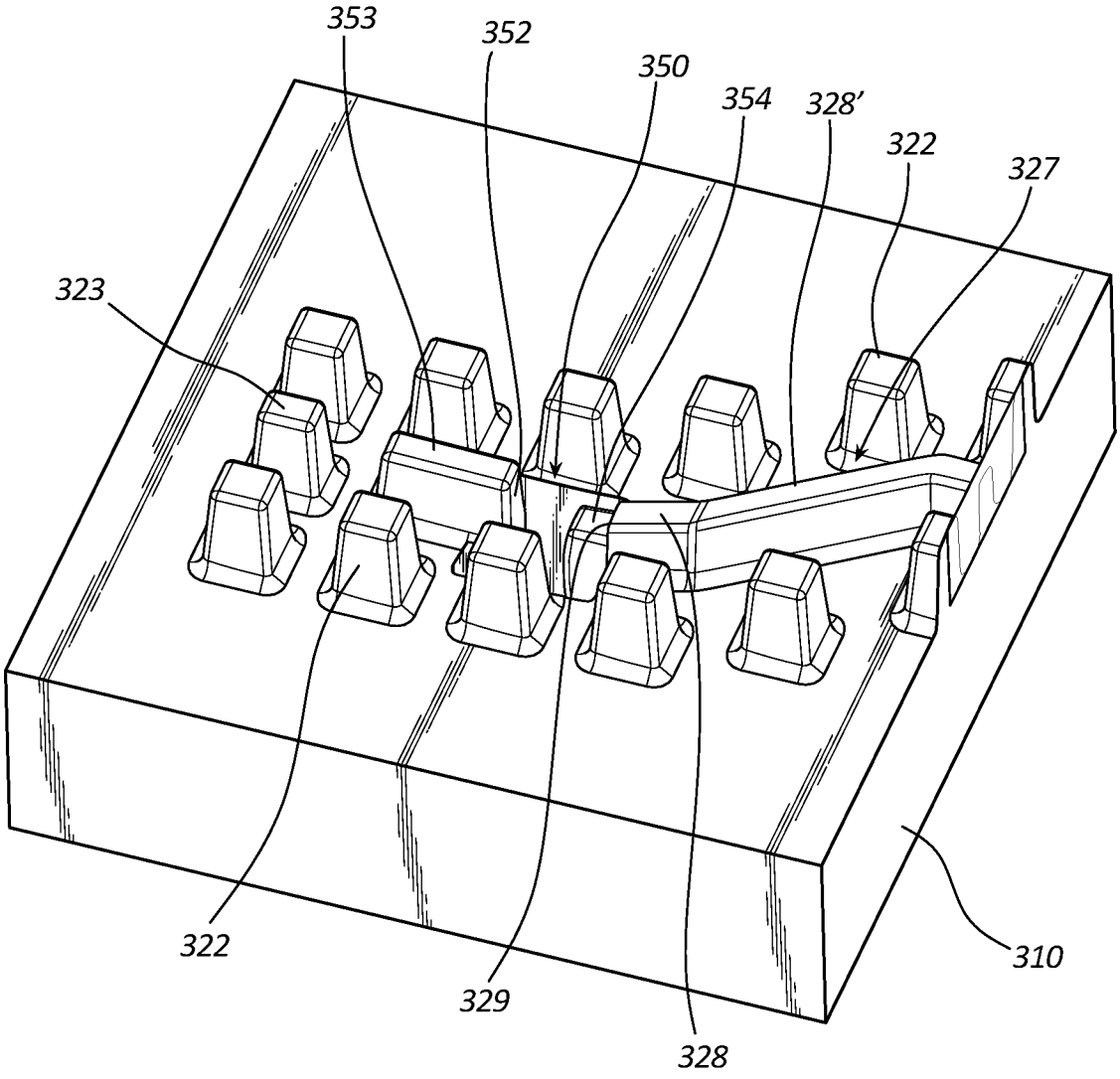
FIG. 4 is a partial, closeup, perspective view of a tuning transitional waveguide structure usable to transition between a horizontal waveguide and a vertical waveguide.

As best seen in FIGS. 1 and 4, a ridge 125 is positioned within each of the waveguide grooves, including the waveguide groove formed on side 112 and side 114. Although a single row of posts 122 is positioned on each side of ridge 125 in the depicted embodiment, other embodiments are contemplated in which two rows, or more than two rows, of such posts may be positioned on either side of ridge 125 or any of the other ridges disclosed herein.

Electromagnetic radiation may travel within the waveguides defined by the aforementioned posts 122 and/or ridges 125 and may be transmitted through the various slots 142 formed in block 110. Ridges 125 may be preferred to enhance the characteristics of the waveguide by further facilitating guidance of electromagnetic waves as desired and/or for satisfying size/dimensional demands.

Antenna assembly 100 further comprises a PCB or other electromagnetic-generating element 170 or another suitable element from which electromagnetic waves may be generated to feed one or more waveguide structures. In the depicted embodiment, PCB 170 is provided in a separate layer but in other embodiments may be provided in the same layer. PCB 170 comprises a microstrip and/or patch antenna element 171, as shown in FIG. 1, which may be used to launch electromagnetic radiation into the waveguide structure formed on side 114 of casting 110.

Such radiation may then be delivered through casting 110 to side 112 by providing a vertical tunnel or "hole" waveguide 150 extending between opposing surfaces of antenna block 110. In the depicted embodiment, waveguide 150 comprises two opposing ridges, namely, ridge 152 and ridge 154, which face one another and extend from the opposing surfaces of an opening, which, again, extends between opposing surfaces of antenna block 110. In addition, the opposing ridges 152 and 154 formed within this hole/tunnel form the shape of a letter "H" and may therefore be referred to as an "H-shaped" or "double-ridged" waveguide. This shape will be more apparent when considered in connection with some of the plan views of other embodiments discussed below. However, both ridges 152 and 154 can be seen in the cross-sectional view of FIG. 2. In alternative embodiments, only a single ridge may be formed in this hole/tunnel, which may instead form the shape of the letter "U" or the Greek letter Π. In still other embodiments, no ridges may be formed in vertical waveguide 150.

Figure 2:
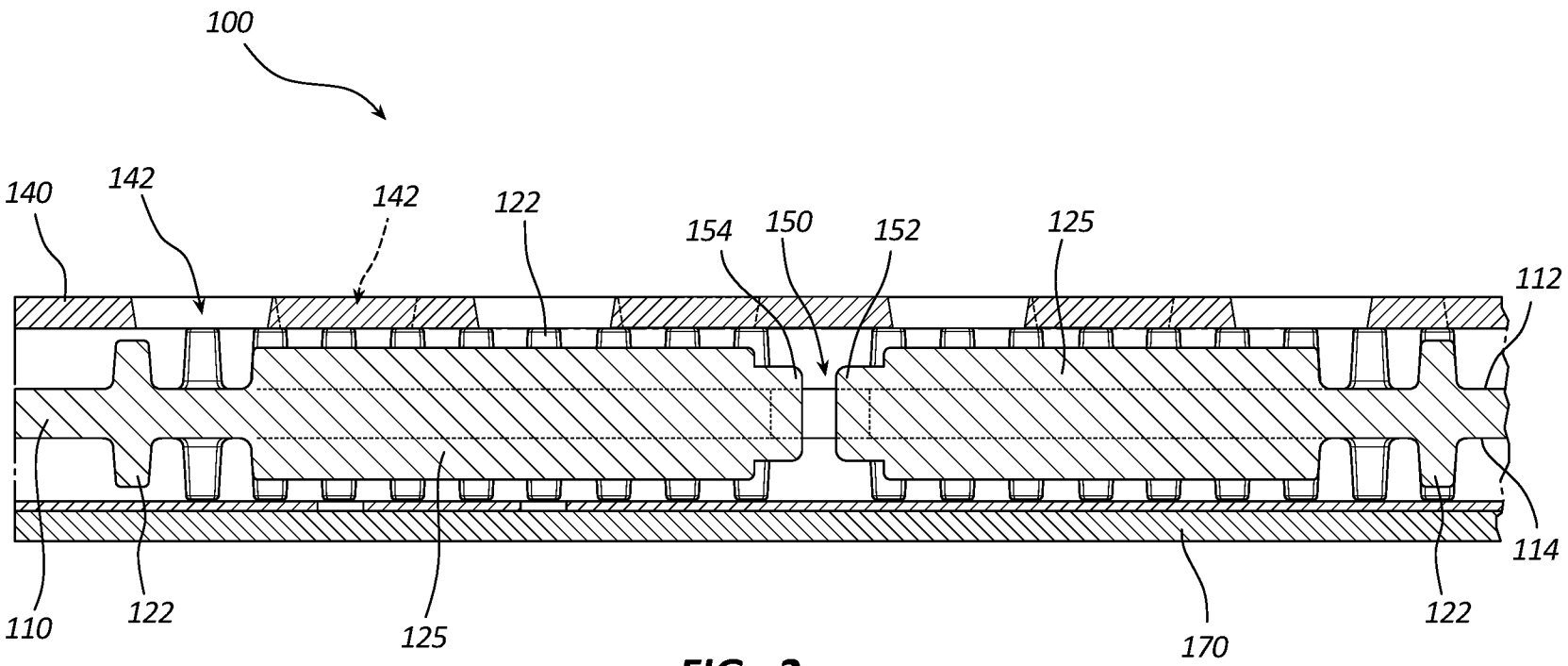
FIG. 2 is a cross-sectional view of the waveguide/antenna assembly of FIG. 1.
Figure 3:
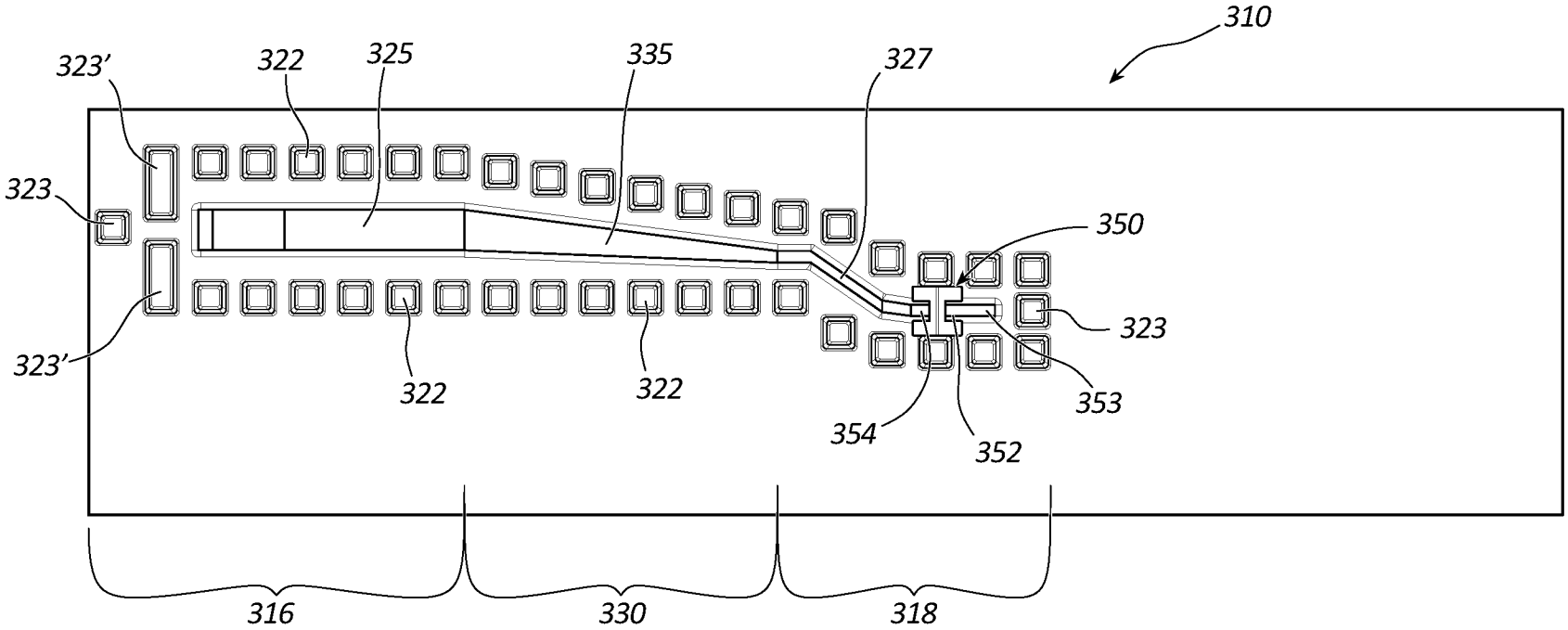
FIG. 3 is a plan view of an antenna block according to other embodiments.

In some embodiments, a transition waveguide section may be provided to facilitate the transition between one or more grooved waveguide sections to a hole/tunnel or "vertical" waveguide, such as waveguide 150 of FIGS. 1 and 2. Thus, FIG. 3 is a plan view of another antenna block 310 according to other embodiments that may be incorporated into a variety of antenna assemblies, including any of the antenna assemblies disclosed herein. Antenna block 310 comprises a plurality of adjacent waveguide sections. More particularly, antenna block 310 comprises a first waveguide section 316 that comprises a waveguide groove defined by opposing rows of posts 322 and a waveguide ridge 325 positioned therein. Terminal posts are also present at the end of the waveguide groove, and include a terminal post 323 positioned along the axis of waveguide ridge 325, which terminal post 323 may be the same or similar in dimension to the other posts 322, or may be larger or otherwise differ in size, along with two larger terminal posts 323' positioned just inside of terminal post 323 and adjacent to opposite rows of posts 322.

Waveguide section 316 may comprise, for example, a waveguide feed section from a PCB or other source of electromagnetic radiation, which is not shown to avoid obscuring the disclosure but, as those of ordinary skill in the art will appreciate, would typically be coupled to antenna block 310. Thus, in some embodiments, the antenna assembly incorporating antenna block 310 may comprise another layer or adjacent element, such as a PCB, to supply such radiation. In some such embodiments, for example, electromagnetic energy may be propagated from a microstrip into waveguide section 316. In other embodiments, however, waveguide section 316 may receive electromagnetic radiation from another adjacent waveguide or waveguide section without directly receiving such radiation.

Another waveguide section 318 is positioned on the opposite end of antenna block 310 relative to waveguide section 316. Waveguide section 318 again comprises a waveguide groove defined by opposing rows of posts 322 and a waveguide ridge 327 positioned therein. Terminal posts 323 are also present at the end of the waveguide groove. Waveguide ridge 327 also angles downward at a first angle relative to the adjacent waveguide ridge (waveguide ridge 325) and again at a second angle relative to the first angled portion, as also shown in FIG. 3.

In addition, waveguide section 318 is coupled to a vertical tunnel or "hole" waveguide 350 extending between opposing surfaces of antenna block 310. As is the case with waveguide 150, waveguide 350 comprises two opposing ridges, namely, ridge 352 and ridge 354, which face one another and extend from the opposing surfaces of an opening, which, again, may between opposing surfaces of antenna block 310. Waveguide section 318 may therefore be thought of as a transitional region to facilitate guidance of electromagnetic radiation from a waveguide groove to a waveguide hole/tunnel. In addition, the opposing ridges 352 and 354 formed within this hole/tunnel form the shape of a letter "H" and may therefore be referred to as an "H-shaped" or "double-ridged" waveguide. Again, however, in other embodiments, a single ridge may be formed in this hole/tunnel, which may instead form the shape of the letter "U" or the Greek letter H, or no ridges at all may be present in waveguide 350.

As also shown in FIG. 3, ridge 327 of waveguide section 318 has a width that is less than ridge 325 of waveguide section 316. Although not visible in FIG. 3, in some embodiments, ridge 327 of waveguide section 318 may also have a greater height than ridge 325 of waveguide section 316. Thus, an adapter section 330 is provided to provide a preferably smooth, but in some cases stepped or otherwise non-smooth, transition between one or both of these two ridge cross-sectional areas/dimensions in order to facilitate the transfer of electromagnetic waves through this transition, preferably with little or no signal loss. Thus, waveguide ridge 335 of adapter section 330 comprises a thickness that tapers between its opposing ends to smoothly transition between the wider ridge 325 of waveguide section 316 and the narrower ridge 327 of waveguide section 318. This taper, or a stepped or otherwise non-smooth transition, may take place in one or more cross-sectional dimensions and may therefore also take place along the height of transitional waveguide ridge 335 if desired.

Transitional waveguide ridge 335 also has a straight side and an opposite tapering side. However, in alternative embodiments, both sides may taper if desired. Similarly, although the same is true for the opposing rows of posts 322 (i.e., one side tapers and the other comprises posts 322 arranged in a non-tapering row), again, alternative embodiments are contemplated in which both rows of posts 322 may taper instead.

Waveguide section 318 may comprise one or more "tuning" features and/or structures that may be adjusted as needed to optimize the transition to vertical waveguide 350 and facilitate transfer of electromagnetic waves between the adjacent gap or groove waveguide section(s), preferably with minimal signal loss. Thus, FIGS. 4 and 5 are close-up views of waveguide section 318 better illustrating these features.

As shown in these figures, waveguide section 318, which is sometimes referred to herein as a transitional region or transitional waveguide section, is positioned adjacent to vertical waveguide 350 and is configured to facilitate redirection of electromagnetic waves from the waveguide sections 316 and/or 330 to the vertical waveguide 350. To do so, transitional region 318 comprises several tuning elements or features, each of which is configured to allow for tuning of one or more physical characteristics of the transitional region 318 to reduce at least one of signal loss and signal distortion of a signal carried by the electromagnetic waves redirected in the transitional region 318.

More particularly, transitional region 318 comprises a terminal tuning ridge 353 positioned on a side of vertical waveguide 350 opposite that of the adjacent waveguide. Stated otherwise, terminal tuning ridge 353 is positioned at the terminal end of the groove waveguide and opposite vertical waveguide 350 from a side from which electromagnetic waves directed through vertical waveguide 350 are transmitted relative to the vertical waveguide 350. One or both of the length of terminal tuning ridge 353, which is defined along the axis of the waveguide and perpendicular, or at least substantially perpendicular to the dimension between opposing posts 322, and the height of terminal ridge 353 may be adjusted as needed in order to tune the performance of the sensor or other device associated with associated waveguides.

Figure 5:
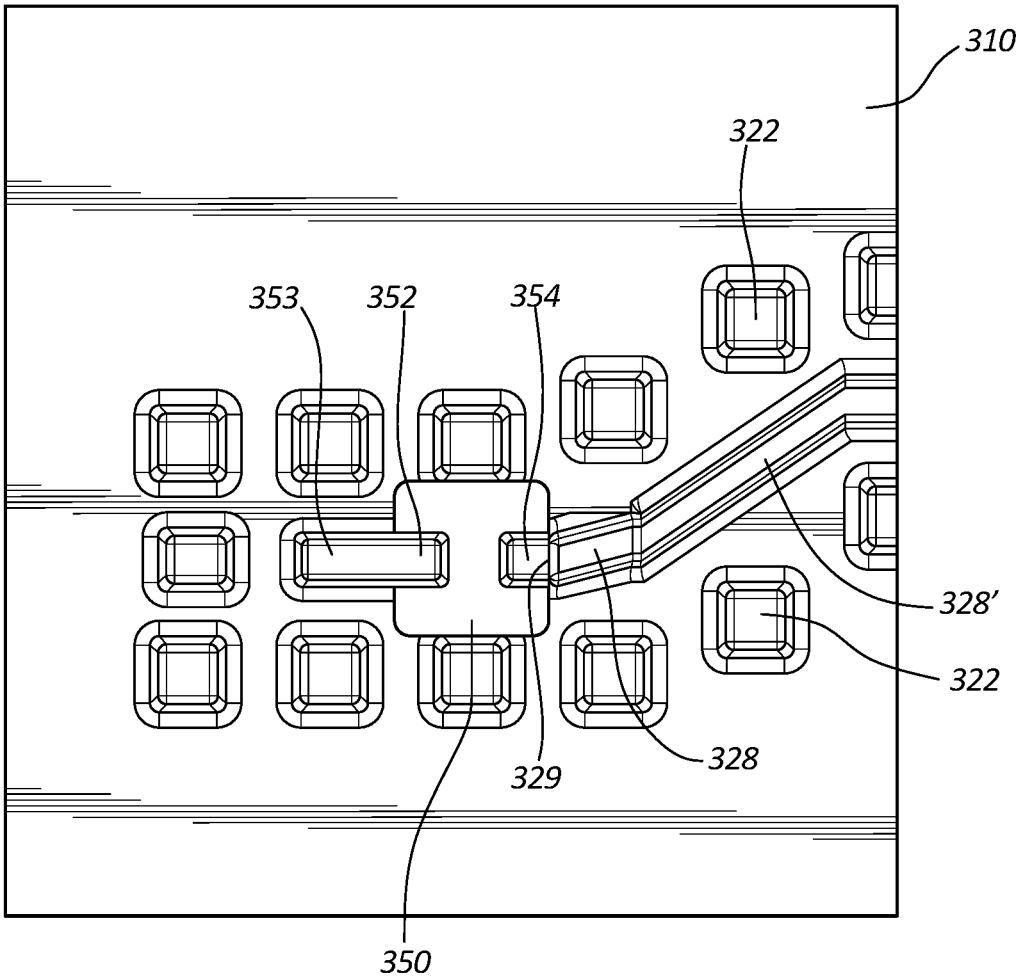
FIG. 5 is a plan view of the waveguide structure of FIG. 4.

As best shown in FIGS. 4 and 5, in some embodiments, terminal tuning ridge 353 may be part of a structure that defines a ridge in one dimension and may, at least in part, also define a ridge of another waveguide in another dimension. More specifically, terminal tuning ridge 353 is part of transitional region 318, which comprises a groove or gap waveguide along a surface of casting/block 310, and also defines in part vertical ridge 352 of vertical waveguide 350. Of course, in other embodiments, these two ridges may be separate elements. In still other embodiments, vertical ridge 352 may be provided without an adjacent horizontal ridge or may be omitted in favor of a horizontal ridge alone.

As another tuning feature, transitional region 318 may comprise a step 329 adjacent to vertical waveguide 350. In the depicted embodiments, step 329 is formed on a side of vertical waveguide 350 opposite from terminal tuning ridge 353. Moreover, in the depicted embodiments, step 329 is, similar to terminal tuning ridge 353, formed along a surface of vertical ridge 354 itself. Step 329 may therefore be considered a step vis-à-vis terminal tuning ridge 353, as it is lower than terminal tuning ridge 353, and a step vis-à-vis the adjacent waveguide ridge 327, which may also be considered a tuning section of transitional region 318, as discussed below. However, again, other embodiments are contemplated in which step 329 may be separate from vertical ridge 354. The height/depth of step 329 may vary and be tuned in accordance with desired design and/or functionality considerations.

Figure 6:
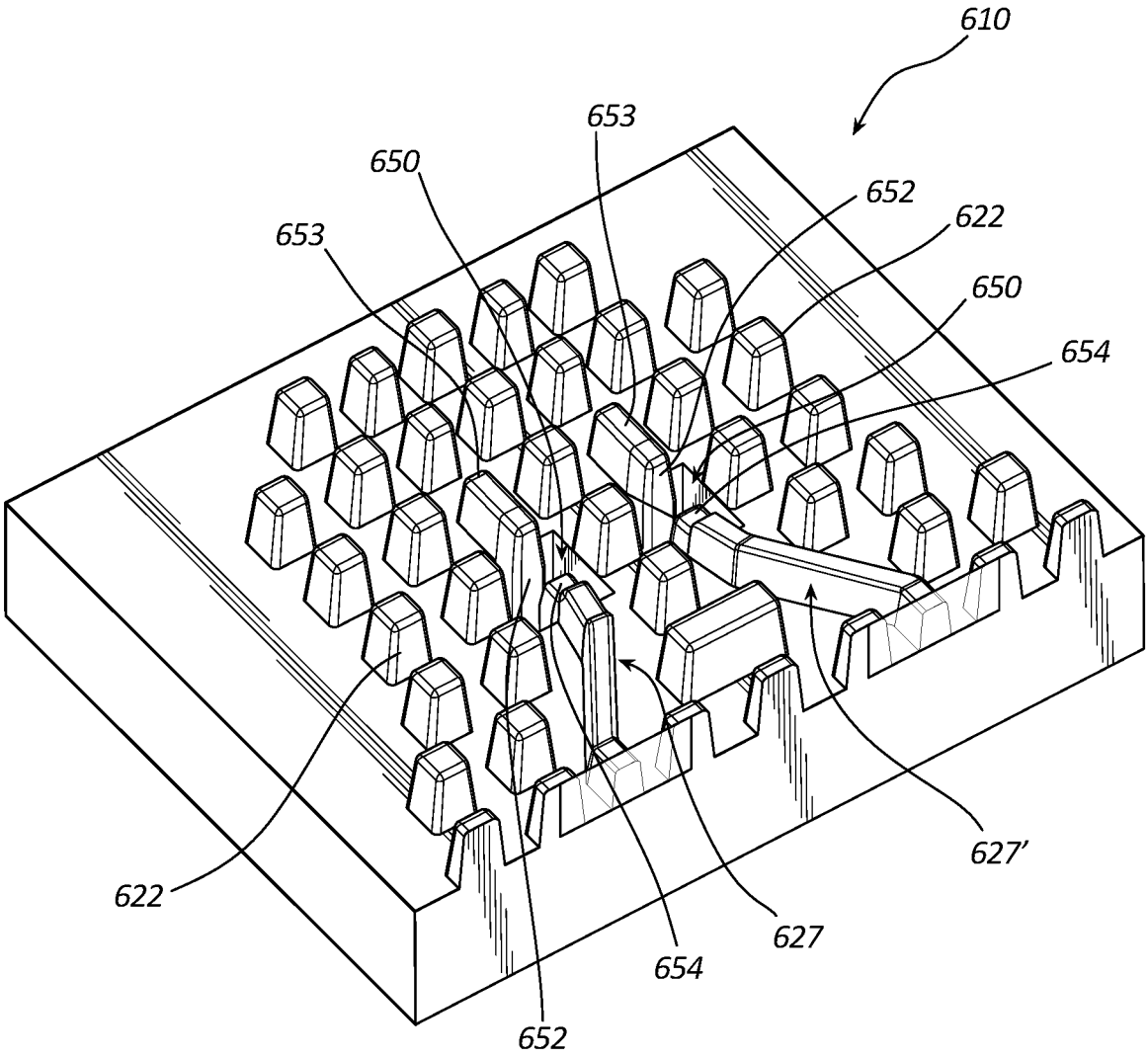
FIG. 6 is a partial, closeup, perspective view of tuning transitional waveguide structures usable to transition between horizontal waveguides and vertical waveguides according to other embodiments.
Figure 7:
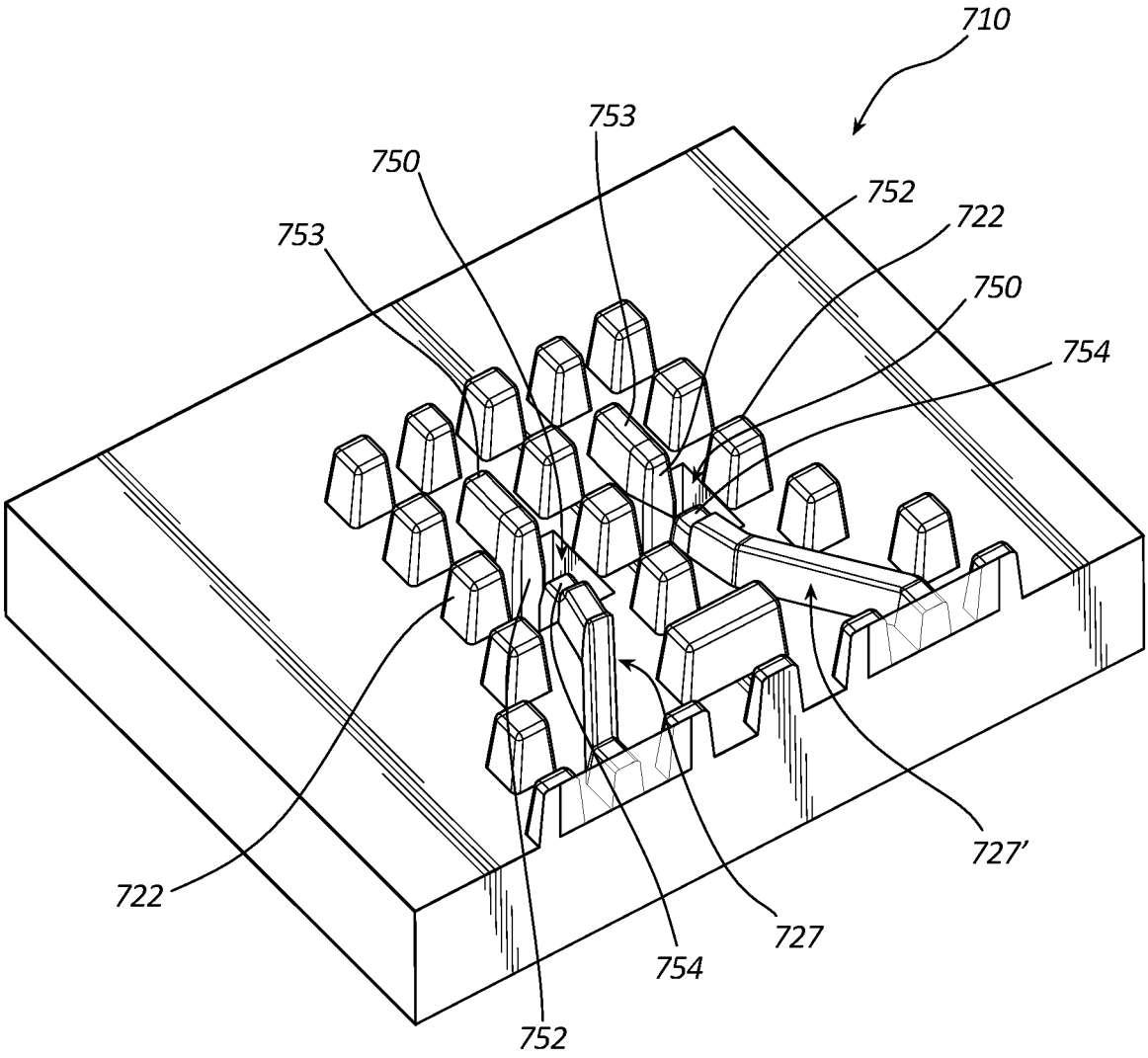
FIG. 7 is a partial, closeup, perspective view of tuning transitional waveguide structures usable to transition between horizontal waveguides and vertical waveguides according to still other embodiments.

As yet another tuning feature, transitional region 318 may comprise various tuning elements/features in waveguide ridge 327, which may also be considered another "tuning" section or element. In the depicted embodiment, waveguide ridge 327 comprises two sections that are angled relative to one another and stepped in height relative to one another. More particularly, ridge section 328, which is adjacent to step 329, extends at a first angle vis-à-vis step 329 and vertical ridge 354, and ridge section 328' extends at an angle vis-à-vis section 328, and at a second angle vis-à-vis step 329. Use of these angled sections may be particularly useful when two transitional sections are in close proximity to one another, as shown in the embodiments of FIGS. 6 and 7. Again, these angles may vary and be tuned as desired in accordance with design and/or functional considerations. In addition, in some embodiments, waveguide ridge 327 may be curved rather than sharply angled and/or may only have a single sharply angled portion rather than two (or may have more than two). Because in preferred embodiments ridge section 327 is offset from the axis of the vertical ridges 352/354 and/or one or more axes of adjacent waveguides, this section may sometimes be referred to herein as an "offset" region or section.

In addition to the angulation of the section comprising waveguide ridge 327, the height, length, and/or width of one or more of the aforementioned portions may be varied to further tune design and/or performance. For example, ridge section 328 may be considered a "tuning section" and therefore may vary in height, width, and/or length as needed. Similarly, there may be another "step" in height between section 328 and section 328', the degree of which may vary as another tuning variable.

FIG. 6 is a partial, perspective view of a transitional waveguide section of an antenna block 610 according to still other embodiments. Again, the transitional portion of antenna block 610 shown in FIG. 6 may be incorporated into a variety of antenna assemblies, including any of the antenna assemblies disclosed herein. Adjacent structures, including both structures that would typically be included on antenna block 610 and structures that would typically be coupled to antenna block 610 to form a complete antenna assembly, are not shown in FIG. 6 so as to avoid unnecessarily obscuring the inventive aspects depicted in the figure.

Antenna block 610 may comprise a plurality of adjacent waveguide sections, including, for example, waveguide sections similar to waveguide sections 316 and/or 330 of antenna block 310. The structures shown in the partial view of FIG. 6 should be considered similar in function and/or purpose to transitional waveguide section 318 of antenna block 310. However, as shown in this figure, there are two adjacent vertical tunnel or hole waveguides 650 extending between opposing surfaces of antenna block 610 and therefore there are two adjacent transitional waveguide sections that are configured to couple and facilitate the transition of the adjacent horizontal waveguide sections to vertical waveguides 650.

The waveguides shown in FIG. 6 again comprise waveguide grooves defined by opposing rows of posts 622 with waveguide ridges 627 and 627' positioned therein. Waveguide ridges 627 and 627' are angled away from the axes of terminal waveguide ridges 653. In addition, waveguide ridges 627 and 627' are angled away from each other, which may allow for use of multiple rows of posts 622 on both sides of ridges 627 and 627', in some cases along with multiple rows of posts on either side of the ridges in the adjacent waveguide grooves from which electromagnetic radiation would be delivered into vertical waveguides 650.

Similar to waveguide section 318, the adjacent transitional waveguide sections of antenna block 610 may have multiple portions that are angled relative to one another. Thus, in the depicted embodiment, a first angled portion extends away from vertical waveguide ridges 654 and a second angled portion extends away from the first angled portion, and at a greater angle relative to waveguide ridges 654, as previously discussed. These two angled portions may also be stepped relative to one another, as previously mentioned (preferably with the more angled portion taller than the first, less angled portion).

As previously mentioned, in preferred embodiments, vertical waveguide 650 comprises two opposing ridges—ridges 652 and 654, which face one another and extend from the opposing surfaces of an opening extending between opposing surfaces of antenna block 610. In the depicted embodiment, opposing ridges 652 and 654 make the hole form the shape of a letter "H" and may therefore be referred to as an "H-shaped" waveguide. Similarly, because of the two ridges, waveguides 650 are also "double-ridged" waveguides. It is contemplated that two ridges may be formed without forming such as shape, however, and therefore a double-ridged waveguide need not also be an H-shaped waveguide. Also, as previously mentioned, in other embodiments, a single ridge may be formed in this hole/tunnel, which may instead form the hole/tunnel into the shape of the letter "U" or the Greek letter 11. As yet another alternative, in some embodiments, no ridges at all may be present in one or both of waveguides 650.

As also shown in FIG. 6, a variety of tuning features may be provided in one or both of the adjacent transitional waveguide sections to optimize the transition from respective adjacent horizontal waveguide sections to vertical waveguides 650. For example, terminal tuning ridges 653 may be positioned on a side of vertical waveguides 650 opposite that of the adjacent horizontal waveguides. The length and/or the height of these terminal tuning ridges 653 may be adjusted as needed in order to tune the performance of the sensor or other device associated with the depicted waveguides.

As with the terminal tuning ridges previously discussed, terminal tuning ridge 653 may be part of a structure that defines ridges in two directions and/or dimensions. More specifically, in the depicted embodiment, terminal tuning ridges 653 are part of structures defining a horizontal waveguide groove and extending through and part of vertical ridges 652 of vertical waveguides 650. As previously mentioned, however, in other embodiments, these two ridges may be separate elements, or a terminal tuning ridge may be omitted.

As another tuning feature, a step, ramp, or ledge may be provided to transition between vertical waveguide ridges 654 and adjacent ridges, such as the adjacent portions of ridges 627/627' and/or the terminal waveguide ridges 653 positioned opposite from vertical waveguides 650.

In addition, waveguide ridges 627 and/or 627' may comprise a plurality of sections (two in the depicted embodiment) that are angled relative to one another and/or stepped in height relative to one another. Again, use of these angled sections may be particularly useful when two transitional sections are in close proximity to one another and may also be tuned to improve sensor performance.

In addition to the angulation of ridges 627/627', the height, length, and/or width of one or more of the aforementioned portions may be varied to further tune design and/or performance. For example, the ridge section(s) of ridge(s) 627/627' immediately adjacent to vertical waveguide ridges 654 may tuned by adjusting the height, width, and/or length as needed. In addition, there may be another "step" in height between these sections and the adjacent waveguide sections, the degree of which may vary as desired to further improve performance.

FIG. 7 is a partial, perspective view of a transitional waveguide section of an antenna block 710 according to yet other embodiments. Again, the transitional portion of antenna block 710 shown in FIG. 7 may be incorporated into a variety of antenna assemblies, including any of the antenna assemblies disclosed herein. Adjacent structures, including both structures that would typically be included on antenna block 710 and structures that would typically be coupled to antenna block 710 to form a complete antenna assembly, are not shown in FIG. 7 so as to avoid unnecessarily obscuring the inventive aspects depicted in the figure.

Antenna block 710 may again comprise a plurality of adjacent waveguide sections. As with antenna block 610, antenna block 710 comprises two adjacent vertical tunnel or hole waveguides 750 extending between opposing surfaces of antenna block 710 and therefore there are two adjacent transitional waveguide sections that are configured to couple and facilitate the transition of a horizontal waveguide section to vertical waveguides 750.

The waveguides shown in FIG. 7 again comprise waveguide grooves defined by opposing rows of posts 722 with waveguide ridges 727 and 727' positioned therein. Waveguide ridges 727 and 727' are, once again, angled away from the axes of terminal waveguide ridges 753 and are also angled away from each other. Unlike the waveguides depicted in antenna block 610, however, only a single row of posts 722 is provided on either side of the associated waveguide ridges.

Otherwise, antenna block 710 may be similar to antenna block 610. Thus, one or more of the adjacent transitional waveguide sections of antenna block 710 may have multiple portions that are angled relative to one another. Thus, in the depicted embodiment, a first angled portion extends away from vertical waveguide ridges 754 and a second angled portion extends away from the first angled portion, and at a greater angle relative to waveguide ridges 754. These two angled portions may also be stepped relative to one another.

Vertical waveguide 750 may also comprise two opposing ridges 752 and 754, which may face one another and extend from the opposing surfaces of an opening extending between opposing surfaces of antenna block 710 to form the shape of a letter "H" if desired.

Any of the various tuning elements and/or features may also be provided, such as terminal tuning ridges 753, the lengths and/or the heights of which may be adjusted as needed in order to tune the performance of the sensor or other device associated with the depicted waveguides.

Steps, ramps, and/or ledges may be provided to transition between vertical waveguide ridges 754 and adjacent ridges, such as the adjacent portions of ridges 727/727' and/or the terminal waveguide ridges 753 positioned opposite from vertical waveguides 750.

In addition, waveguide ridges 727 and/or 727' may comprise one or more sections that are angled relative to one another and/or stepped in height relative to one another, the angles and/or degrees to which may be adjusted as a tuning feature. In addition to the angulation of ridges 727/727', the height, length, and/or width of one or more of the aforementioned portions may be varied to further tune design and/or performance. For example, the ridge section(s) of ridge(s) 727/727' immediately adjacent to vertical waveguide ridges 754 may tuned by adjusting the height, width, and/or length as needed. In addition, there may be another "step" in height between these sections and the adjacent waveguide sections, the degree of which may vary as desired to further improve performance.

Figure 8:
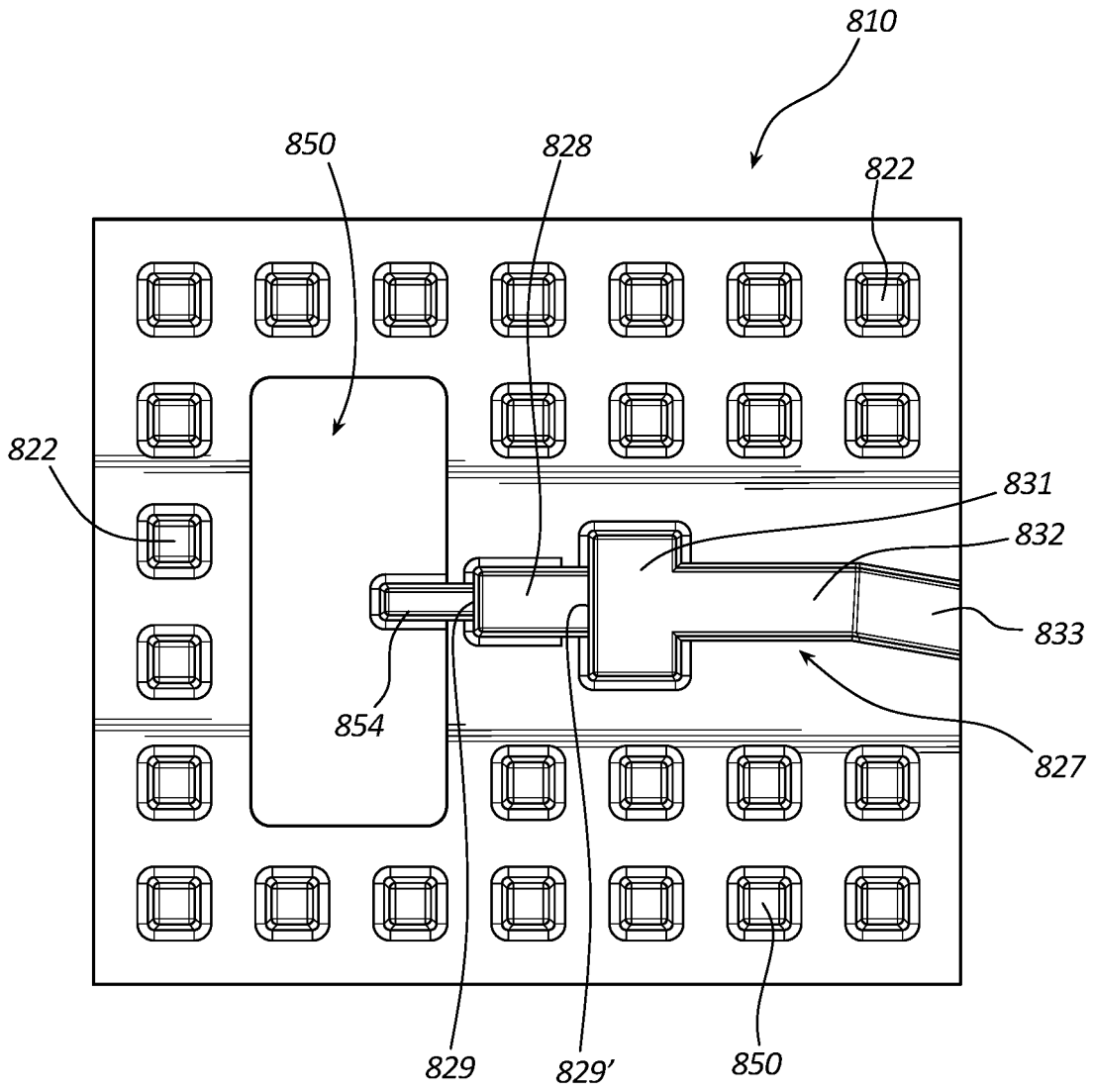
FIG. 8 is a plan view of a tuning transitional waveguide structure usable to transition between a horizontal waveguide and a vertical waveguide according to yet other embodiments.

FIG. 8 is a plan view depicting yet another example of a transitional/tuning section of a waveguide of a waveguide and/or antenna block 810. In this embodiment, as with several of the embodiments previously discussed, posts 822 are aligned in multiple rows on either side of a ridge to form a waveguide groove on block 810. In addition, a vertical waveguide 850 is shown, which may extend between opposing sides of antenna block 810 (only a single side is shown in FIG. 8). However, unlike the embodiments depicted in previous drawings, vertical waveguide 850 comprises a single ridge 854 that extends into a rectangular-shaped hole to define, at least substantially, a U-shaped opening. In some embodiments, ridge 854 may extend above the surface of block 810 from which posts 822 extend and may therefore, at least in part, define both a vertical waveguide ridge and a horizontal waveguide ridge. However, in other embodiments, ridge 854 may solely serve as and/or define a vertical waveguide ridge.

An adjacent waveguide ridge section 828 may be provided, which may be wider than ridge 854. A step 829 may be provided to transition between the respective heights of ridge 854 (in the vertical direction) and waveguide ridge section 828. A similar step or steps may be provided in the opposite dimension to transition between the respective widths of these adjacent ridge sections. However, as previously mentioned, in other embodiments, it is contemplated that one or both of these transitions may be omitted or made smooth by providing one or more tapering and/or ramped surfaces to transition between adjacent ridge sections.

Similarly, another waveguide ridge section 831 is provided adjacent to section 828. Ridge section 831 may again be wider and/or taller than ridge section 828. As with the transition between vertical ridge 854 and ridge section 828, the transition between ridge section 828 and ridge section 831 may be stepped at 829' in height and may also be stepped along one or both sides of ridge section 828 in width.

Again, various aspects/features of the depicted transitional region may be adjustable for tuning, such as the depth of one or more of the aforementioned steps, the lengths, widths, and/or heights of any of the aforementioned ridge sections, etc. As another example, transitional waveguide ridge 827 comprises two sections that are angled relative to one another. More particularly, ridge section 832 extends from section 831 and decreases in width vis-à-vis ridge section 831 (in some embodiments, another step in height may also be provided at this transition). In the depicted embodiment, ridge section 832 comprises the same, or at least substantially the same, width as section 828 on the opposite side of section 831, although this need not be the case in all contemplated embodiments.

Another section 833 extends from section 832 and extends at an angle therefrom. This angle and/or the various heights, widths, and/or lengths of any of these sections may vary and be tuned as desired in accordance with design and/or functional considerations.

The foregoing specification has been described with reference to various embodiments and implementations. However, one of ordinary skill in the art will appreciate that various modifications and changes can be made without departing from the scope of the present disclosure. For example, various operational steps, as well as components for carrying out operational steps, may be implemented in various ways depending upon the particular application or in consideration of any number of cost functions associated with the operation of the system. Accordingly, any one or more of the steps may be deleted, modified, or combined with other steps. Further, this disclosure is to be regarded in an illustrative rather than a restrictive sense, and all such modifications are intended to be included within the scope thereof. Likewise, benefits, other advantages, and solutions to problems have been described above with regard to various embodiments. However, benefits, advantages, solutions to problems, and any element(s) that may cause any benefit, advantage, or solution to occur or become more pronounced, are not to be construed as a critical, a required, or an essential feature or element.

Those having skill in the art will appreciate that many changes may be made to the details of the above-described embodiments without departing from the underlying principles of the invention. The scope of the present inventions should, therefore, be determined only by the following claims.

The invention claimed is:

1. An antenna module, comprising:

an antenna block comprising one or more structures defining a first waveguide on a first surface of the antenna block and a second waveguide comprising one or more structures on a second surface of the antenna block, the first surface being distinct from the second surface such that the one or more structures of the first surface extend in a different direction with respect to the one or more structures of the second surface; and a vertical waveguide extending from the first surface of the antenna block to the second surface of the antenna block, wherein the vertical waveguide is coupled with the first waveguide and the second waveguide, wherein the first waveguide comprises a transitional region adjacent to the vertical waveguide, wherein the transitional region is configured to facilitate redirection of electromagnetic waves from the first waveguide to the vertical waveguide.

2. The antenna module of claim 1, wherein the vertical waveguide comprises:

a first ridge positioned on a first side of the vertical waveguide and extending between the first surface of the antenna block and the second surface of the antenna block; and a second ridge positioned on a second side of the vertical waveguide opposite from the first side of the vertical waveguide and extending between the first surface of the antenna block and the second surface of the antenna block.

3. The antenna module of claim 2, wherein the vertical waveguide defines an opening between the first surface of the antenna block and the second surface of the antenna block that is at least substantially in a shape of a letter H in cross section.

4. The antenna module of claim 1, wherein the transitional region comprises at least one tuning element configured to allow for tuning of one or more physical characteristics of the transitional region to reduce at least one of signal loss and signal distortion of a signal carried by the electromagnetic waves redirected in the transitional region.

5. The antenna module of claim 4, wherein the at least one tuning element comprises at least one of:

a depth of a step between a tuning section of a first waveguide ridge of the first waveguide and the first ridge of the vertical waveguide;

at least one of a height, a length, and a width of the tuning section adjacent to the first ridge of the vertical waveguide, the height being defined in a direction at least substantially perpendicular to the first surface of the antenna block and the length being defined in a direction at least substantially perpendicular to the height, and the width being defined in a direction at least substantially perpendicular to both the length and the height;

an offset region extending along the first waveguide, the offset region directing the first waveguide at an acute angle relative to at least one of the first and second ridges of the vertical waveguide; and a terminal tuning ridge positioned on a side of the first waveguide opposite from a side from which electromagnetic waves directed through the vertical waveguide are transmitted relative to the vertical waveguide.

6. The antenna module of claim 5, wherein the at least one tuning element comprises at least the offset region, and wherein the offset region comprises an offset ridge portion.

7. The antenna module of claim 6, wherein the offset ridge portion comprises at least one of multiple straight ridge portions angled relative to each other and a curved ridge portion extending the offset ridge portion away from the vertical waveguide.

8. The antenna module of claim 1, wherein the first waveguide and the second waveguide each comprises a waveguide groove and a waveguide ridge positioned therein, and wherein each of at least a subset of the waveguide ridges of the first and second waveguides is contiguous with at least one of the first ridge and the second ridge of the vertical waveguide.

9. The antenna module of claim 8, wherein the waveguide groove of each of the first waveguide and the second waveguide is at least partially defined by a plurality of posts positioned opposite from one another and having a waveguide ridge positioned within the respective waveguide groove between opposite posts of the plurality of posts.

10. An antenna module, comprising:

a first waveguide defined by a first plurality of posts formed in a waveguide layer of the antenna module and a first waveguide ridge positioned in between at least two opposing rows of the first plurality of posts;

a second waveguide defined by a second plurality of posts formed in the waveguide layer and a second waveguide ridge positioned in between at least two opposing rows of the second plurality of posts;

a vertical waveguide coupled with the first waveguide and the second waveguide and extending through the waveguide layer, wherein the vertical waveguide is configured to direct electromagnetic waves between the first waveguide and the second waveguide, wherein the vertical waveguide comprises:

a first ridge extending through the waveguide layer; and a second ridge extending through the waveguide layer; and a transitional region operably coupled between the first waveguide and the vertical waveguide, wherein the transitional region is configured to facilitate redirection of electromagnetic waves from the first waveguide to the vertical waveguide, wherein the transitional region comprises a transitional ridge, and wherein the transitional region further comprises at least one of:

at least one step in a height of the transitional ridge; and at least one offset region in which the transitional ridge extends away from a direction of the vertical waveguide such that at least one of the first ridge and the second ridge of the vertical waveguide is not aligned with a portion of the first waveguide ridge adjacent to the transitional region.

11. The antenna module of claim 10, wherein the transitional ridge is contiguous with and operably coupled with the first ridge of the vertical waveguide at a first end and is contiguous with and operably coupled with the first waveguide ridge at a second end opposite from the first end.

12. The antenna module of claim 10, wherein the at least one step is positioned at a terminal end of the transitional ridge adjacent to the vertical waveguide.

13. The antenna module of claim 12, wherein the transitional region further comprises a terminal tuning ridge positioned opposite from the vertical waveguide relative to the first waveguide.

14. The antenna module of claim 13, wherein the terminal tuning ridge extends from the waveguide layer at a height that differs from a height of the transitional ridge.

15. The antenna module of claim 10, wherein the at least one offset region comprises a straight offset portion extending from the vertical waveguide at an acute angle.

16. The antenna module of claim 15, wherein the transitional region further comprises a tuning section positioned in between the offset region and the vertical waveguide, wherein the tuning section is at least one of angled and stepped relative to the straight offset region.

17. The antenna module of claim 16, wherein the transitional ridge comprises a first step coincident with at least a portion of the first ridge of the vertical waveguide and a second step between the straight offset portion and the tuning section.

18. The antenna module of claim 17, wherein the first step comprises an abrupt step.

19. The antenna module of claim 17, wherein the tuning section is both angled and stepped relative to the straight offset portion.

20. An antenna module, comprising:

an antenna block comprising a first waveguide on a first side of the antenna block and a second waveguide on a second side of the antenna block; and a vertical waveguide extending through the antenna block and operably coupled with the first waveguide and the second waveguide to facilitate guidance of electromagnetic waves between the first waveguide and the second waveguide, the vertical waveguide comprising at least one vertical ridge protruding from an opening formed in the antenna block; and a transitional waveguide positioned on the first side of the antenna block and operably coupled to the first waveguide and the vertical waveguide, wherein the transitional waveguide is configured to facilitate redirection of electromagnetic waves from the first waveguide to the vertical waveguide, and wherein the transitional waveguide comprises:

a horizontal ridge at least partially defining the at least one vertical ridge of the vertical waveguide; and a transitional ridge extending in a direction angled away from a direction from which the at least one vertical ridge extends from the opening.

21. The antenna module of claim 20, wherein the transitional ridge extends along a curved line away from the direction from which the at least one vertical ridge extends from the opening.

* * * * *